US009434186B2

(12) United States Patent
Gracia Verdugo et al.

(10) Patent No.: US 9,434,186 B2
(45) Date of Patent: Sep. 6, 2016

(54) PRINT SUBSTRATE EDGE HOLDER

(71) Applicant: HEWLETT-PACKARD DEVELOPMENT COMPANY, L.P., Houston, TX (US)

(72) Inventors: Antonio Gracia Verdugo, Barcelona (ES); Francesc Melia Sune, Palma de Mallorca (ES); Ezequiel Jordi Rufes Bernad, Sant Feliu de Llobregat (ES)

(73) Assignee: HEWLETT-PACKARD DEVELOPMENT COMPANY, LP., Houston, TX (US)

( * ) Notice: Subject to any disclaimer, the term of this patent is extended or adjusted under 35 U.S.C. 154(b) by 0 days.

(21) Appl. No.: 14/775,024

(22) PCT Filed: Apr. 15, 2013

(86) PCT No.: PCT/US2013/036617

§ 371 (c)(1),
(2) Date: Sep. 11, 2015

(87) PCT Pub. No.: WO2014/171919

PCT Pub. Date: Oct. 23, 2014

(65) Prior Publication Data

US 2016/0023481 A1 Jan. 28, 2016

(51) Int. Cl.
*B41J 11/00* (2006.01)

(52) U.S. Cl.
CPC ..... *B41J 11/0085* (2013.01); *B41J 11/001* (2013.01); *B41J 11/005* (2013.01); *B41J 11/0005* (2013.01); *B41J 11/0065* (2013.01)

(58) Field of Classification Search
CPC . B41J 11/0065; B41J 11/007; B41J 11/0085; B41J 11/06; B41J 13/103
USPC ..... 347/104
See application file for complete search history.

(56) References Cited

U.S. PATENT DOCUMENTS

| | | | | |
|---|---|---|---|---|
| 6,179,285 | B1 | 1/2001 | Teumer et al. | |
| 6,382,850 | B1 * | 5/2002 | Freund | B41J 3/60 347/102 |
| 6,523,933 | B1 | 2/2003 | Hirano et al. | |
| 6,910,757 | B2 | 6/2005 | Kanamitsu et al. | |
| 6,932,455 | B2 | 8/2005 | Monclus et al. | |
| 8,348,416 | B2 | 1/2013 | Ozaki et al. | |
| 2006/0221166 | A1 * | 10/2006 | Inoue | B41J 13/02 347/104 |
| 2008/0012931 | A1 | 1/2008 | Gros et al. | |
| 2009/0179971 | A1 | 7/2009 | Hibbard et al. | |
| 2010/0209169 | A1 | 8/2010 | Mandel et al. | |
| 2011/0292145 | A1 * | 12/2011 | Hoover | B41J 11/06 347/104 |

FOREIGN PATENT DOCUMENTS

| | | |
|---|---|---|
| JP | 2004175017 | 6/2004 |

* cited by examiner

*Primary Examiner* — Manish S Shah
*Assistant Examiner* — Roger W Pisha, II
(74) *Attorney, Agent, or Firm* — HP Inc. Patent Department

(57) ABSTRACT

In one example, a print substrate edge holder includes a first part to hold down the edge of a print substrate without covering any part of the substrate in the print zone and a second part overlapping the first part to collect printing fluid dispensed past the edge of the print substrate.

10 Claims, 10 Drawing Sheets

PRINT SUBSTRATE EDGE HOLDER

BACKGROUND

The side edges of flexible print substrates may curl as the substrate moves through the print zone, particularly when ink is dispensed onto the edge of the substrate for "full bleed" printing in which there are no lateral margins. Large format inkjet printers, for example, may print on paper, vinyl and textiles in varying widths supplied as rolls of flexible web. The edges of the print substrate should be kept flat in the print zone during printing, including at the edges during full bleed printing.

DRAWINGS

FIGS. 1-3 illustrate an inkjet printer implementing one example of a new substrate edge holder. FIG. 3 is viewed along the line 3-3 in FIG. 1. FIG. 2 is viewed along the line 2-2 in FIG. 3.

FIG. 5 is a close-up view of the structure indicated by circle 5 in FIG. 4.

The same part numbers designate the same or similar parts throughout the figures.

DESCRIPTION

A new substrate edge holder has been developed to help keep the edges of the substrate flat during full bleed printing while also collecting ink dispensed past the edge of the substrate (so-called "overspray"). Thus, examples of the new edge holder perform the dual functions of edge holder and gutter for full bleed printing. In one example, the new edge holder includes a first part to hold down the edge of the print substrate without covering any part of the substrate in the print zone and a second part overlapping the first part to collect printing fluid dispensed past the edge of the print substrate. In one specific implementation, the first part is configured to apply a vacuum to the edge of the print substrate and the second part is configured as a disposable, absorbent pad covering the first part.

Examples of the new substrate edge holder are described below with reference to a wide format, scanning printhead type inkjet printer. The new edge holder, however, is not limited to such inkjet printers or even to inkjet printing, but may be implemented in other printers and for dispensing other printing fluids. Accordingly, the examples shown and described illustrate but do not limit the invention, which is defined in the Claims following this Description.

Figure 1:
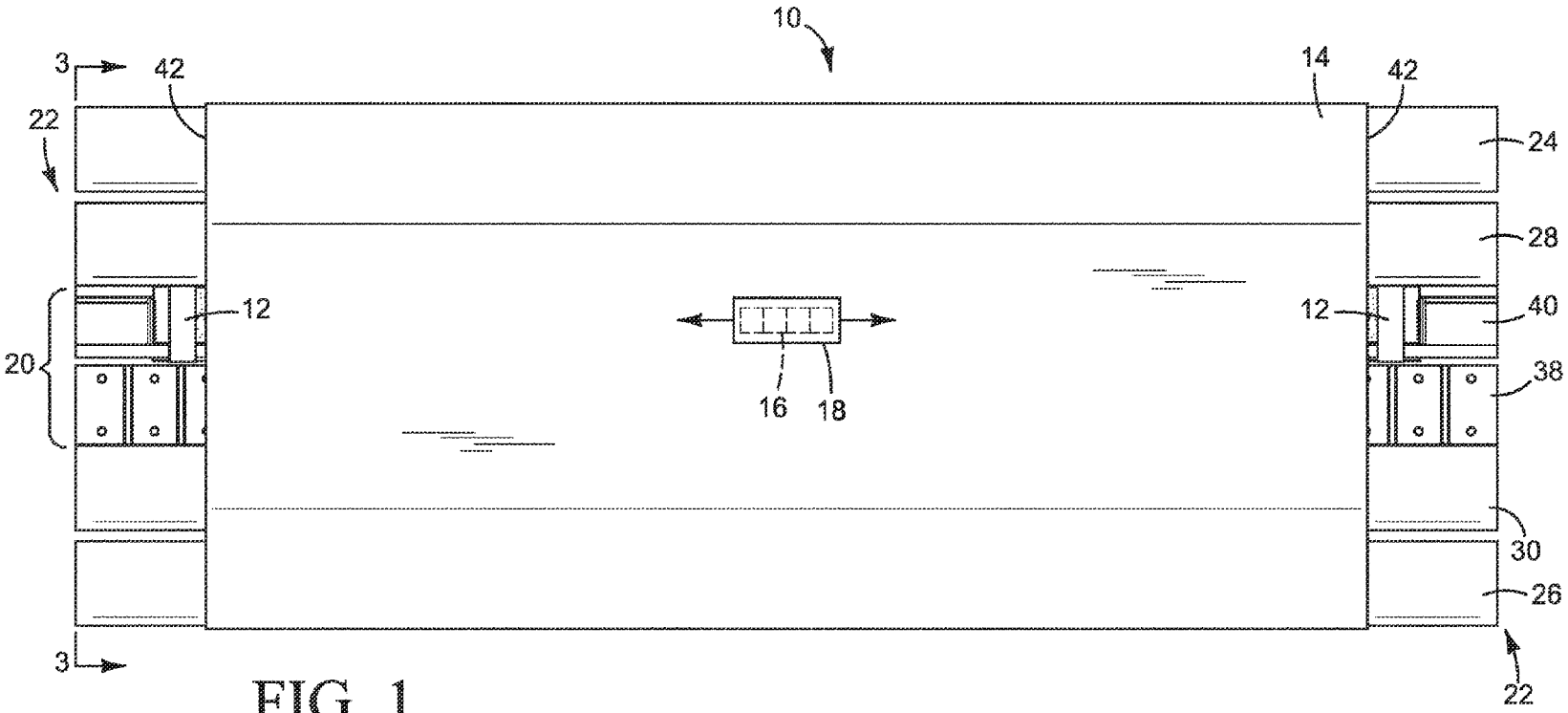
Figure 2:
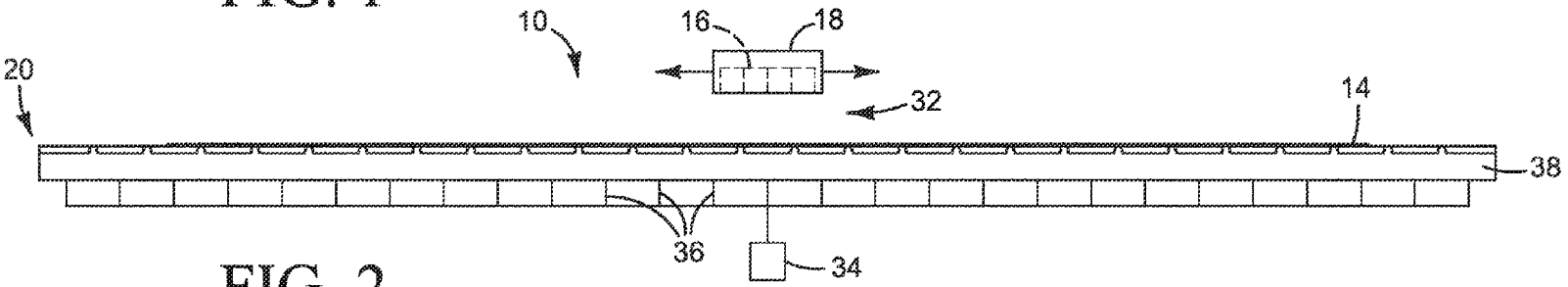
Figure 3:
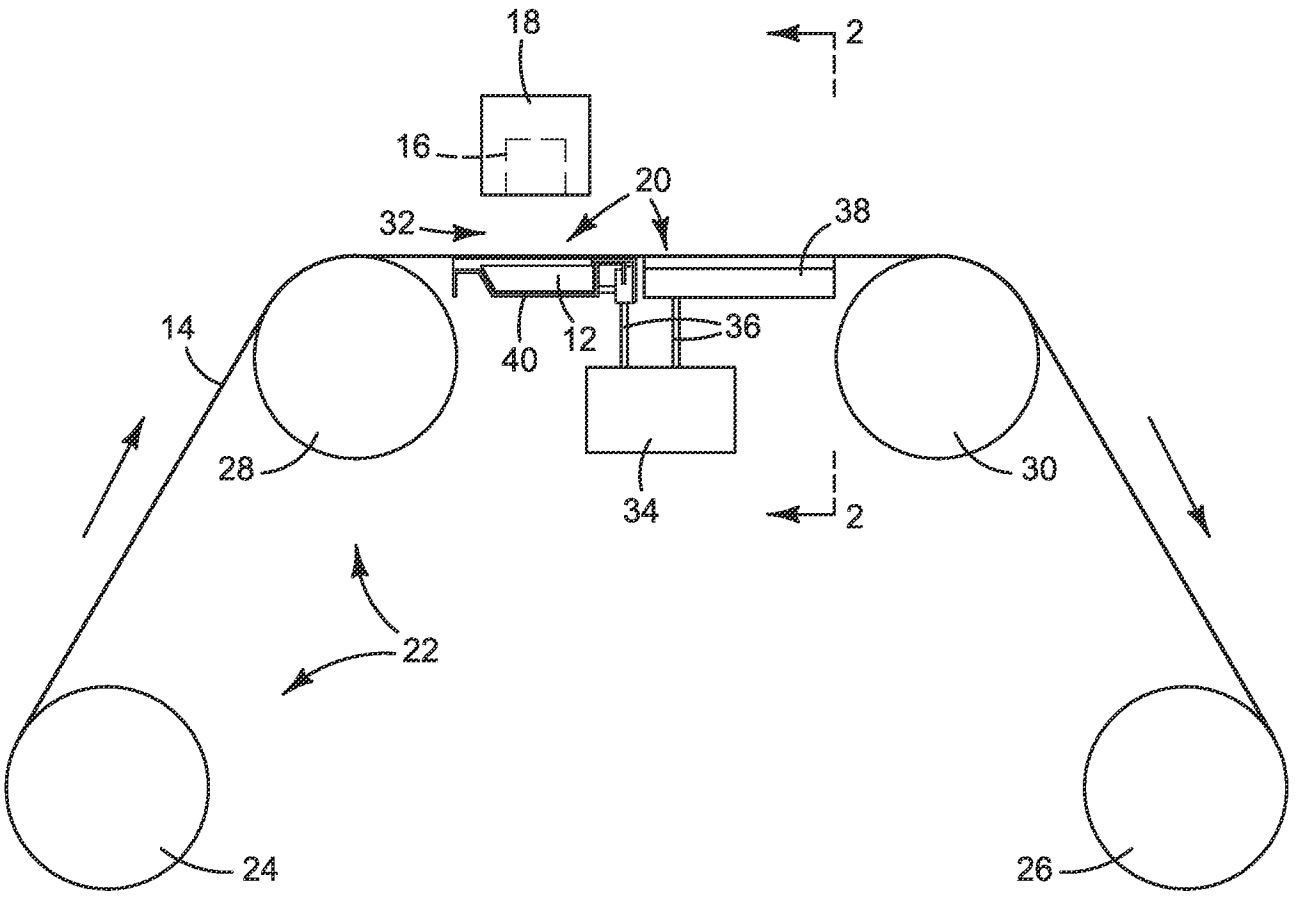

FIGS. 1-3 illustrate an inkjet printer 10 implementing one example of a new substrate edge holder 12 positioned at each edge of print substrate 14. Edge holder 12 is shown in more detail in FIGS. 4-10. Referring first to FIGS. 1-3, printer 10 includes a group of multiple printheads 16, for example to dispense different color inks, mounted on a carriage 18 over a platen assembly 20. A substrate transport 22 in printer 10 includes a web supply roller 24 and a web take-up roller 26. A web print substrate 14 extends from supply roller 24 over platen assembly 20 and intermediate rollers 28, 30 to take-up roller 26. Intermediate rollers 28, 30 may be used, for example, to help control the direction and tension of web 14 through a print zone 32 over platen assembly 20. Printheads 16 dispense ink or other printing fluid as they are scanned back and forth on carriage 18 across substrate 14 passing over platen assembly 20 through print zone 32. An air pump or other suitable vacuum source 34 operatively coupled to platen assembly 20 through a system of air passages 36 and controls (not shown) may be used to exert a hold-down force on print substrate 14 as necessary or desirable for some printing operations.

Figure 4:
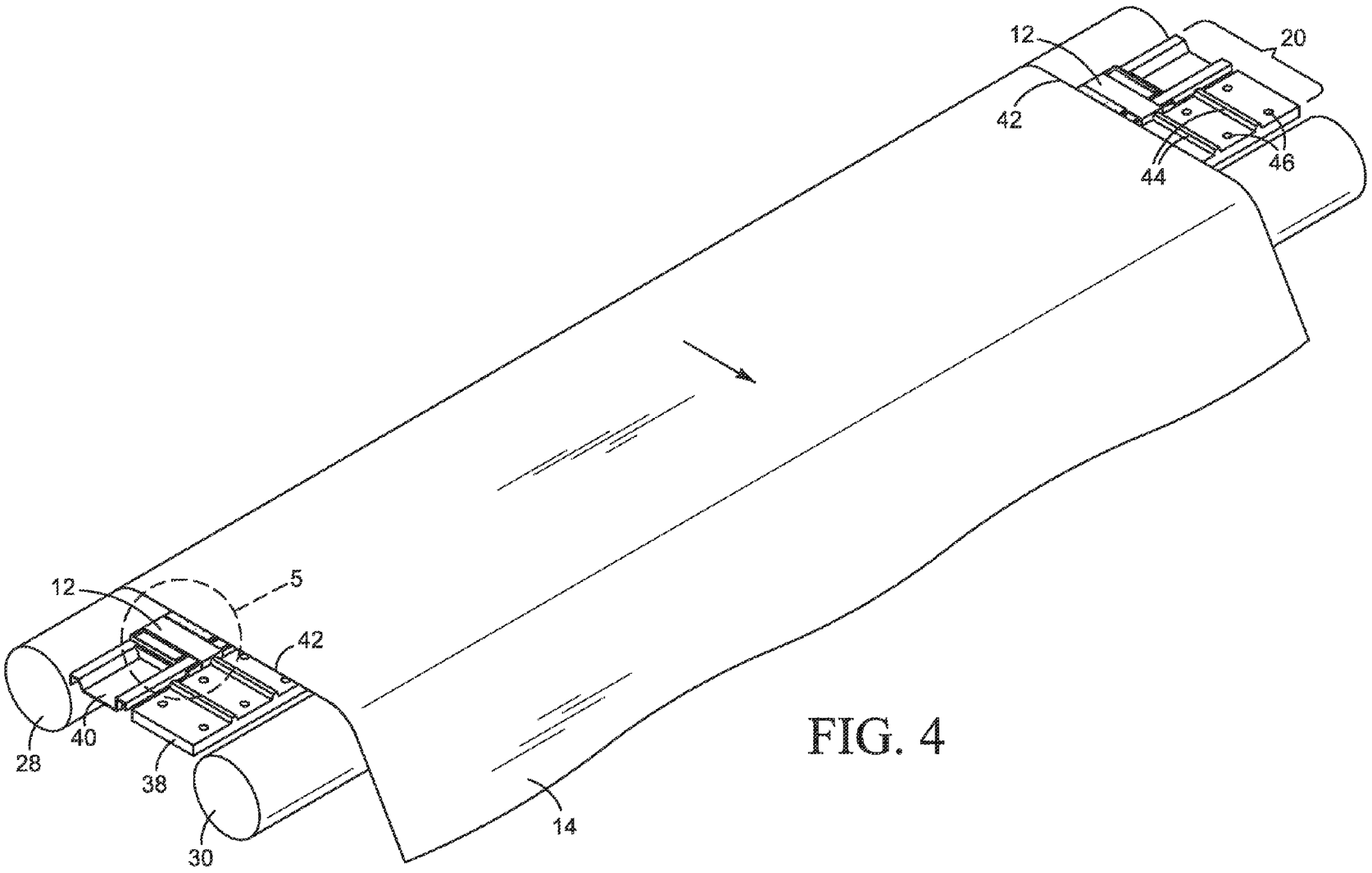
FIGS. 4 and 5 show the substrate edge holder in the printer of FIGS. 1-3 in more detail.
Figure 5:
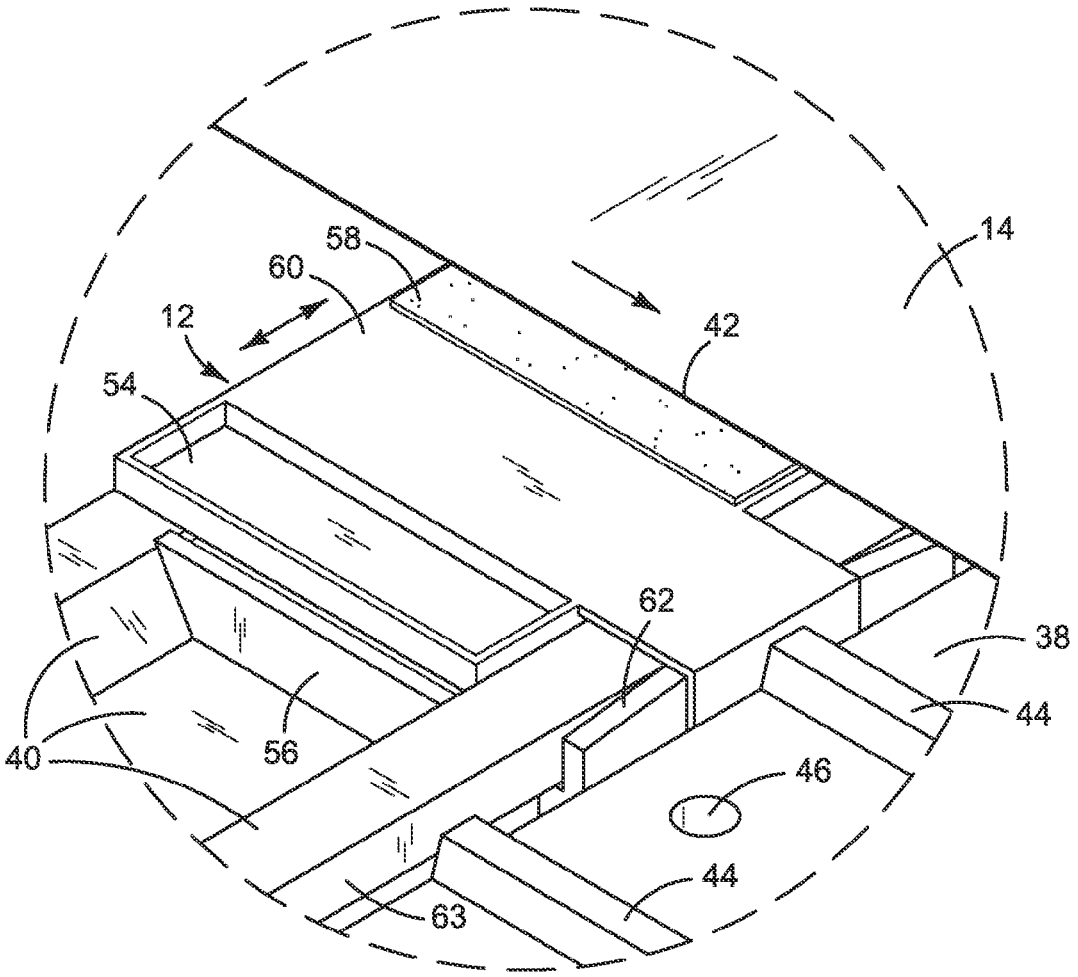
Figure 6:
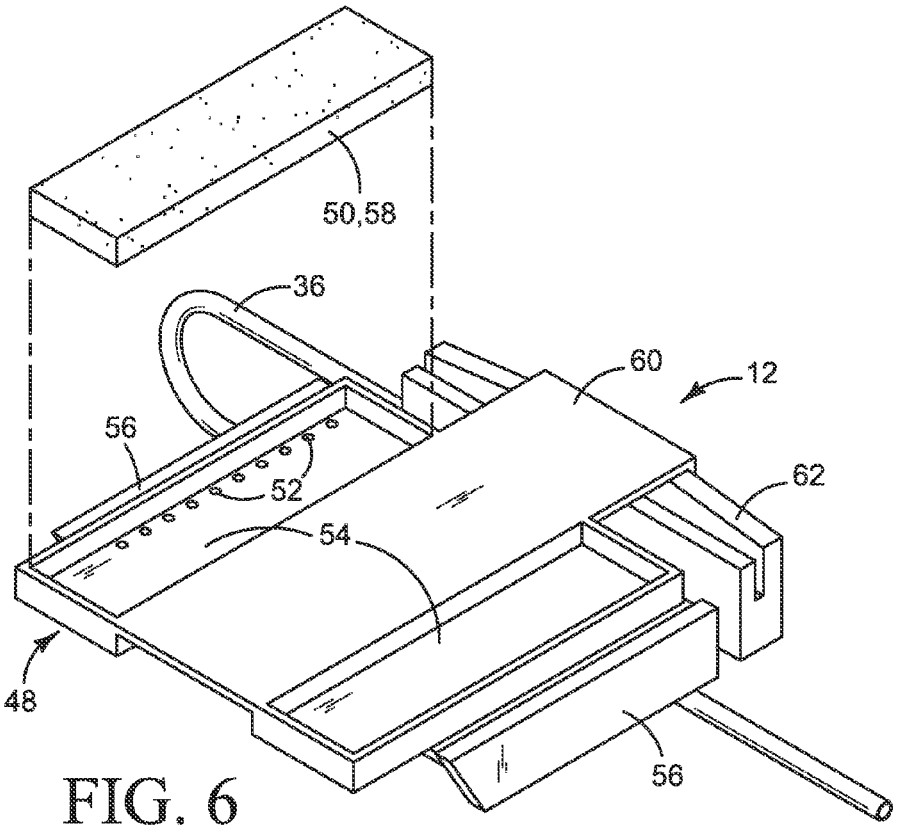
FIGS. 6 and 7 are top down and bottom up perspective views.
Figure 7:
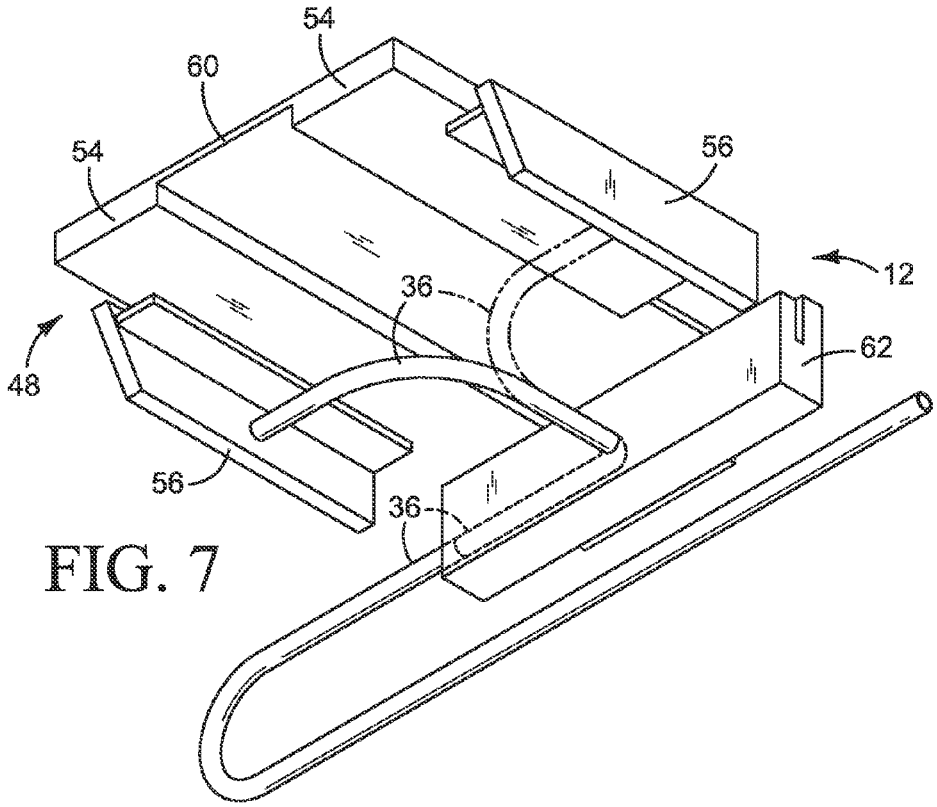
Figure 8:
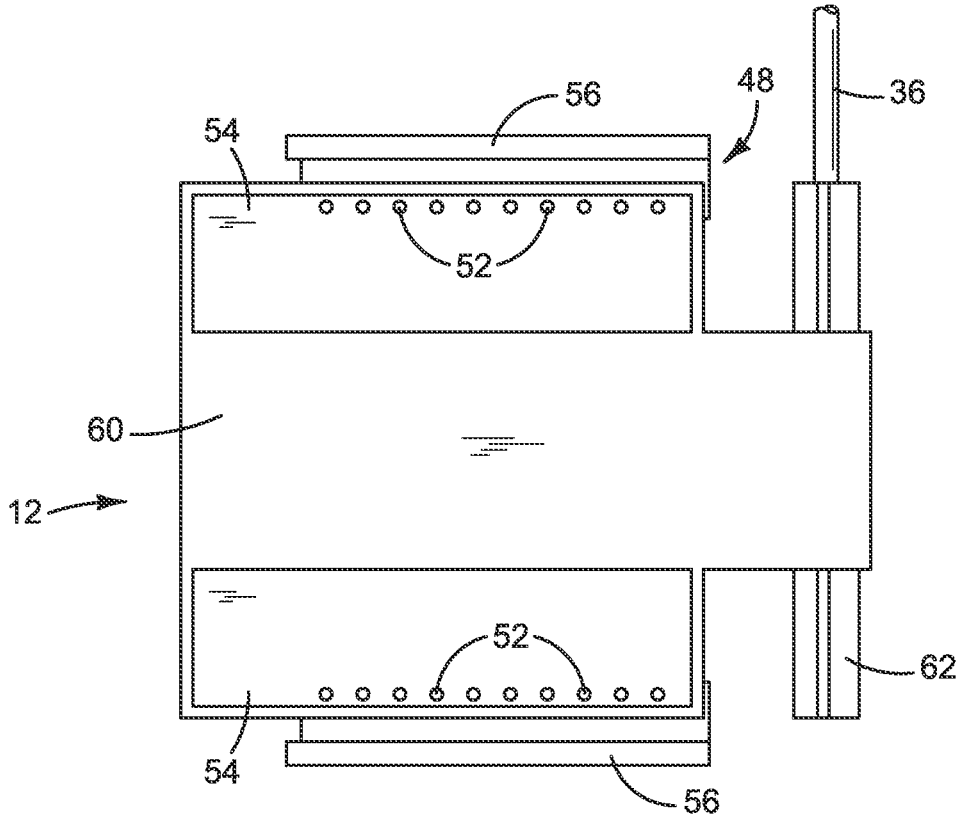
FIGS. 8 and 9 are plan and elevation views, respectively, of the substrate edge holder shown in FIGS. 1-5.

Referring now also to FIGS. 4 and 5, in the example shown, platen assembly 20 includes a vacuum platen 38, a gutter 40, and an edge holder 12 mounted to gutter 40 at each edge 42 of print substrate 14. Vacuum platen 38 includes a series of ridges 44 spaced apart across print zone 32 to support print substrate 14 and an array of openings 46 connected to vacuum source 34 through air passages 36. Accordingly, a vacuum may be applied across platen 38 to hold substrate 14 against ridges 44 to help keep substrate 14 flat as it moves through print zone 32.

Figure 9:
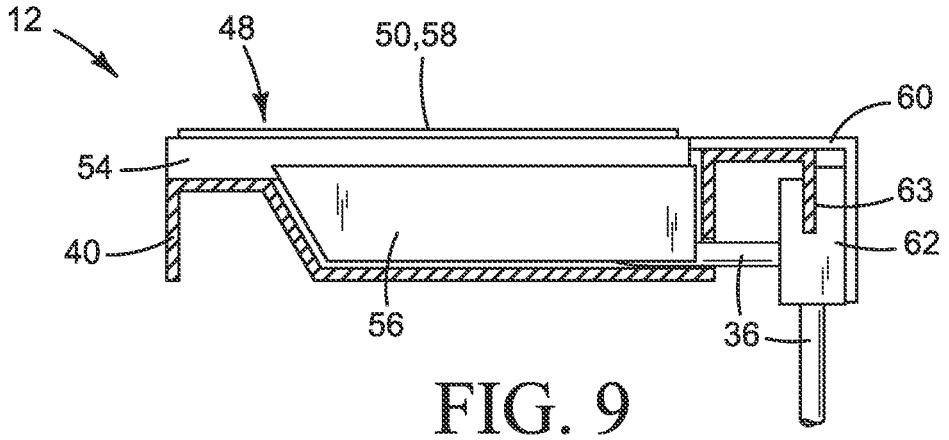
Figure 10:
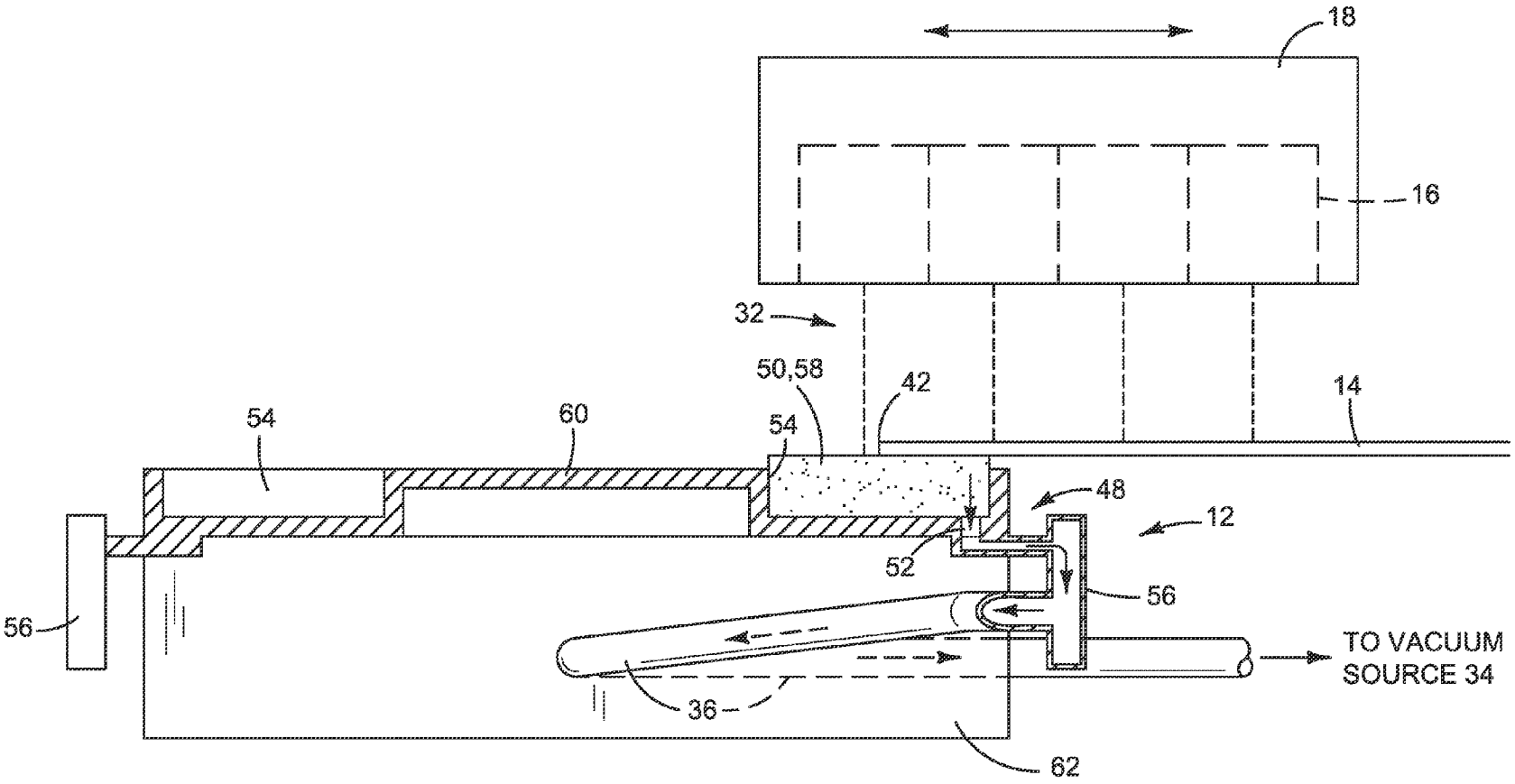
FIG. 10 is a close-up view illustrating the edge holding and overspray collecting functions of the substrate edge holder shown in FIGS. 1-9.

Referring to FIGS. 5-10, each edge holder 12 includes (1) a first part 48 to hold down one edge 42 of print substrate 14 in print zone 32 without covering any part of substrate 14 in print zone 32 and (2) a second part 50 overlapping first part 48 to collect ink or other printing fluid dispensed past edge 42. In the example shown, edge holder first part 48 is configured to apply a vacuum to substrate edge 42, such as with vacuum holes 52 in the bottom of a receptacle 54 connected to vacuum source 34 through a plenum 56 and air passage 36. In the example shown, edge holder second part 50 is configured as an absorbent pad 58 that sits in receptacle 54. As best seen in FIG. 10, when vacuum is supplied to holes 52, edge holder 12 simultaneously holds down substrate edge 42 and collects any printing fluid dispensed past edge 42. Positioning vacuum holes 52 along the inboard part of receptacle 54 under edge 42, as shown, helps maximize the vacuum hold down force while minimizing the risk of sucking printing fluid through absorbent pad 58 and into the vacuum system. Also, while pad 58 need not overlap vacuum holes 52 as shown, this overlap helps secure pad 58 in position as print substrate 14 moves over pad 58. In the configuration shown, a disposable absorbent pad 58 can be easily inserted into receptacle 54 and secured there during printing, and easily removed from receptacle 54 for disposal.

In the example shown in FIGS. 5-10, edge holder 12 includes a paddle shaped base 60 forming receptacles 54 and extending across the width of gutter 40. Base 60 is affixed to or integrated with a mount 62 that mounts edge holder 12 along gutter 40. Mount 62 may be adjustable along gutter 40 for different width print substrates 14, for example, using a slotted mount 62 slidable along the gutter flange 63 as shown in FIGS. 5 and 9. Plenums 56 may be integrated into base 60 as part of receptacles 56 or affixed to base 60 as discrete parts. Although vacuum air passages 36 are shown as flexible tubes, any suitable conduit may be used. For edge holders 12 that are adjustable along gutter 40, a loop in each vacuum tube 36, shown in FIG. 7, may be used to accommodate the change in position of edge holders 12. Edge holder 12 may be used on both sides of platen assembly 20 (FIG. 5) along either substrate edge 42 by placing pad 58 in the appropriate (left or right) receptacle 52 and connecting vacuum tube 36 to the corresponding plenum 56 (as indicated by phantom lines for tube 36 in FIG. 7).

Figure 11:
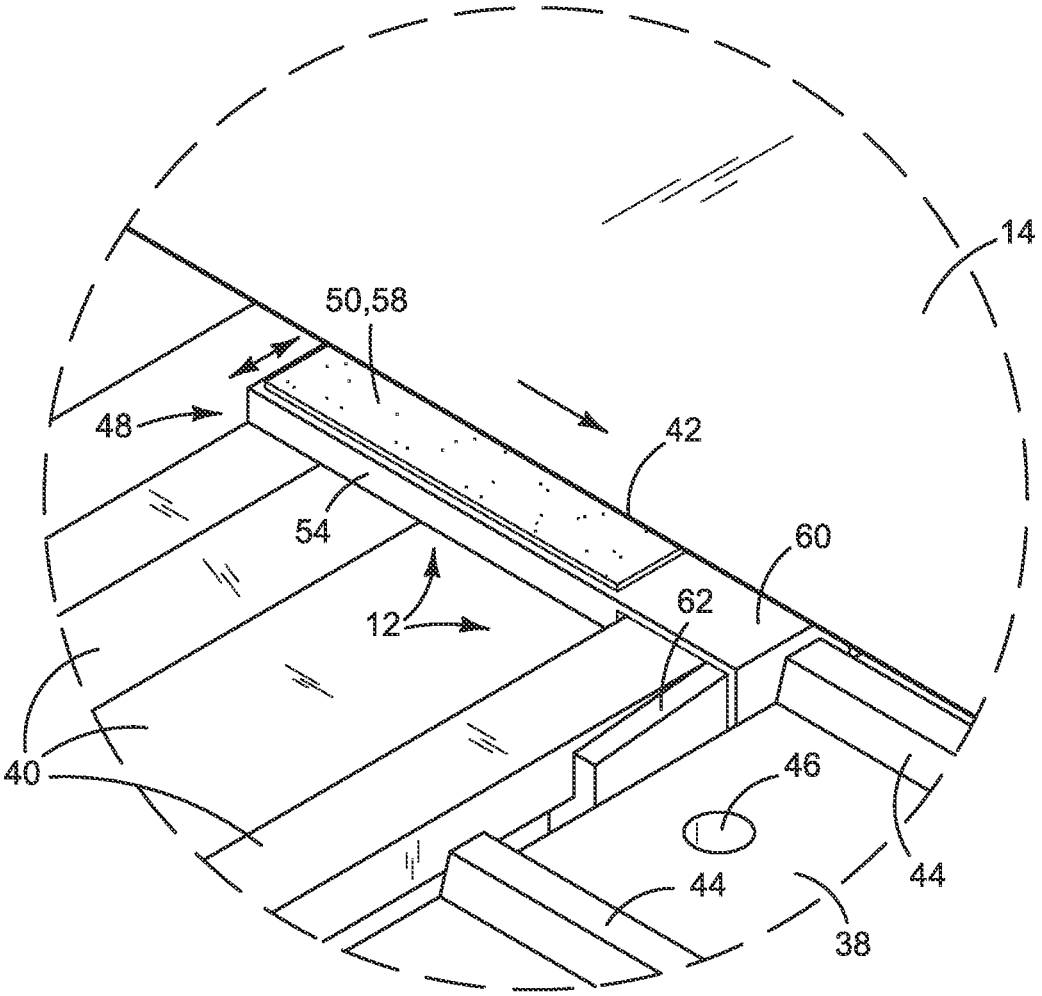
FIGS. 11-13 illustrate another example of the new substrate edge holder.
Figure 12:
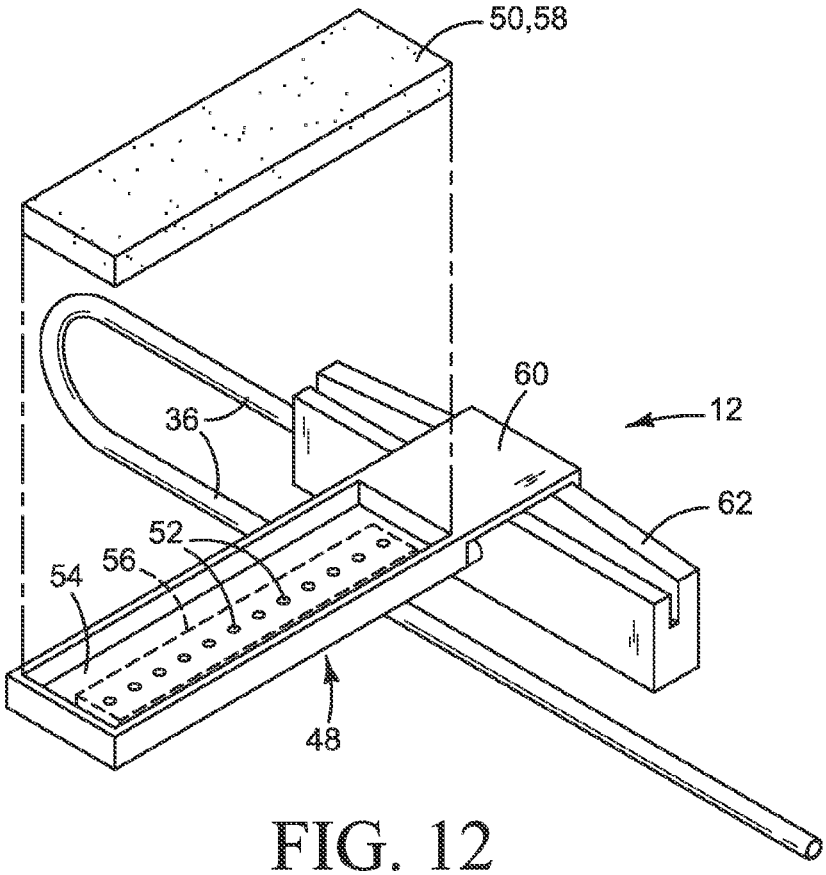
Figure 13:
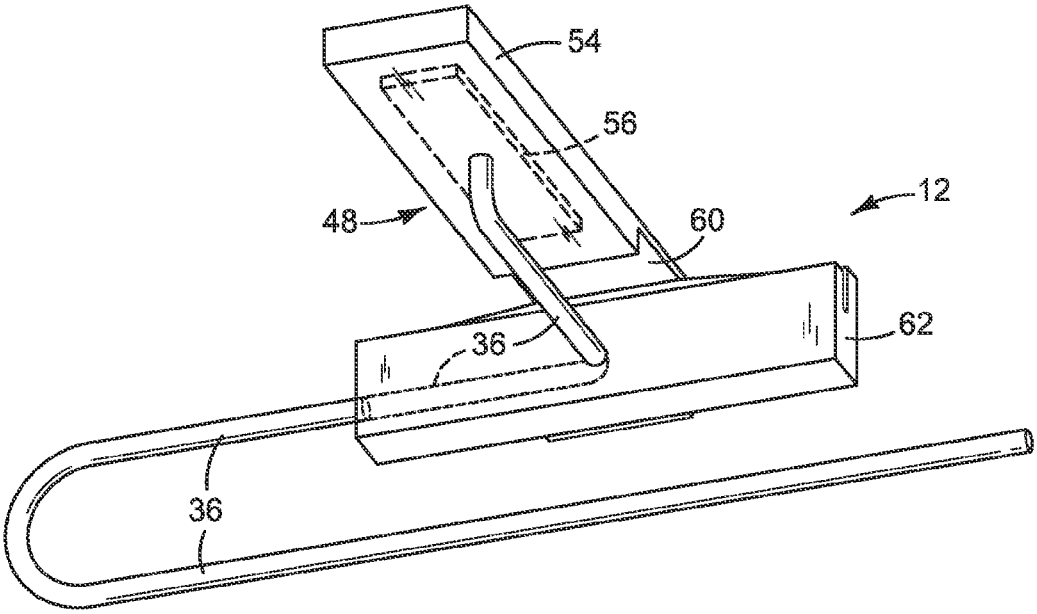

FIGS. 11-13 illustrate another example of the new substrate edge holder 12. Referring to FIGS. 11-13, in this example edge holder 12 includes a single receptacle 54 and vacuum tube 36 is connected to a plenum 56 formed in the floor of receptacle 54. In this example, vacuum holes 52 may be aligned along the center of receptacle 54, as shown, for use on both edges 42 of substrate 14.

Figure 14:
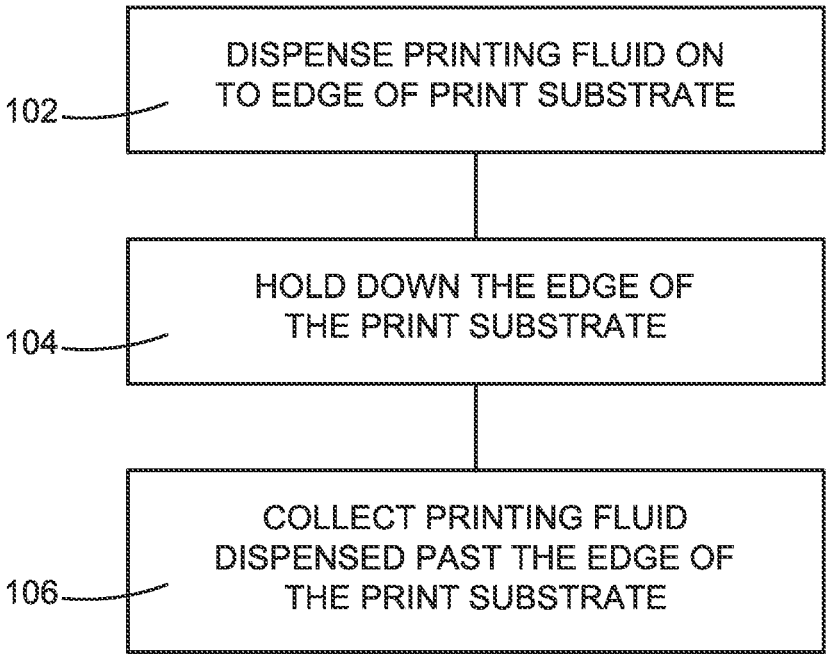
FIG. 14 is a flow diagram illustrating one example of a new printing method that may be implemented, for example, using an edge holder like those shown in FIGS. 1-10 and 11-13.

FIG. 14 illustrates one example of a new printing method that may be implemented, for example, using an edge holder 12 like those shown in FIGS. 1-10 and 11-13. Referring to FIG. 14, ink or other printing fluid is dispensed on to the edge of the print substrate (step 102) while simultaneously holding down the edge of the substrate (step 104) and collecting printing fluid dispensed past the edge of the substrate (step 106). In one example, the substrate edge is held down in step 104 by applying a vacuum to the edge of the print substrate and any printing fluid dispensed past the edge of the substrate is collected in step 106 by absorbing the fluid.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A print substrate edge holder for use in a printer, comprising:

a first part to hold down an edge of a print substrate in a print zone without covering any part of the print substrate in the print zone; and a second part overlapping the first part to collect printing fluid dispensed past the edge of the print substrate, wherein the first part and the second part are adjustable together to different positions across the print zone, and wherein the first part is detachable from the printer.

2. The holder of claim 1, wherein: the first part is configured to apply a vacuum to the edge of the print substrate; and the second part comprises a disposable part covering the first part.

3. The holder of claim 2, wherein the disposable part comprises an absorbent pad.

4. The holder of claim 1, wherein: the first part comprises a receptacle and holes in the receptacle; and the second part comprises an absorbent pad in the receptacle covering the holes.

5. The holder of claim 4, wherein the holes are arranged in a line along one side of the receptacle or in a line along the center of the receptacle.

6. The holder of claim 5, further comprising a vacuum source connected to the holes in the receptacle.

7. The holder of claim 6, further comprising a plenum between the vacuum source and the holes in the receptacle.

8. A print substrate edge holder configured to simultaneously hold down an edge of a print substrate and absorb printing fluid dispensed past the edge of the print substrate, comprising:

vacuum holes to hold down the edge of the print substrate; and a disposable absorbent pad covering the vacuum holes to absorb printing fluid dispensed past the edge of the print substrate.

9. A method comprising simultaneously holding down an edge of a print substrate, dispensing printing fluid onto the edge of the print substrate, and collecting printing fluid dispensed past the edge of the print substrate in a disposable absorbent pad covering vacuum holes.

10. The method of claim 9, wherein:

holding down the edge of the print substrate comprises applying a vacuum to the edge of the print substrate; and collecting printing fluid dispensed past the edge of the print substrate comprises absorbing printing fluid dispensed past the edge of the print substrate.

* * * * *